United States Patent [19]

Kline et al.

[11] 3,996,592

[45] Dec. 7, 1976

[54] ANTENNA WITH ROTATABLE SENSITIVITY PATTERN

[75] Inventors: Larry H. Kline, Beachwood; Milosh L. Ukmar, Euclid, both of Ohio

[73] Assignee: Orion Industries, Inc., Los Angeles, Calif.

[22] Filed: Jan. 17, 1974

[21] Appl. No.: 434,134

Related U.S. Application Data

[63] Continuation-in-part of Ser. No. 430,418, Feb. 4, 1965, abandoned.

[52] U.S. Cl. ..... 343/817; 343/844; 343/876

[51] Int. Cl.[2] ..... H01Q 3/24

[58] Field of Search ..... 343/120, 817, 818, 834, 343/835, 836, 844, 876

[56] References Cited

UNITED STATES PATENTS

| | | | |
|---|---|---|---|
| 1,860,123 | 5/1932 | Yagi | 343/837 |
| 2,349,976 | 5/1944 | Matsudaira | 343/832 |
| 2,962,715 | 11/1960 | Byatt | 343/120 |
| 3,175,219 | 3/1965 | Wernick et al. | 343/876 |

*Primary Examiner*—Eli Lieberman
*Attorney, Agent, or Firm*—Albert L. Ely, Jr.

[57] ABSTRACT

Antenna having a selectively rotatably extendable sensitivity pattern provided by an array of three or more dipole antenna units, each of substantially equal mechanical length and located at the corners of a substantially regular polygon having the same number of sides as the number of units in the array and switching means having connections to each dipole unit to selectively energize at least one of said units and interpose an electrically-lengthening inductive reactance in at least two other units located, with respect to the direction in which the sensitivity is to be extended, behind and on either side of an energized unit to serve as parasitic reflectors extending the lobe of sensitivity of an energized unit in the selected direction.

5 Claims, 8 Drawing Figures

INVENTORS
LARRY H. KLINE,
& MILOSH L. UKMAR
BY
Ely, Golnick & Flynn
ATTORNEYS

Fig. 3
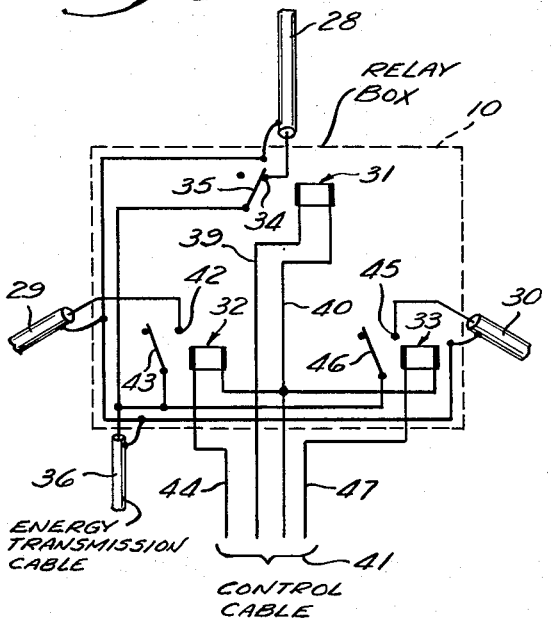
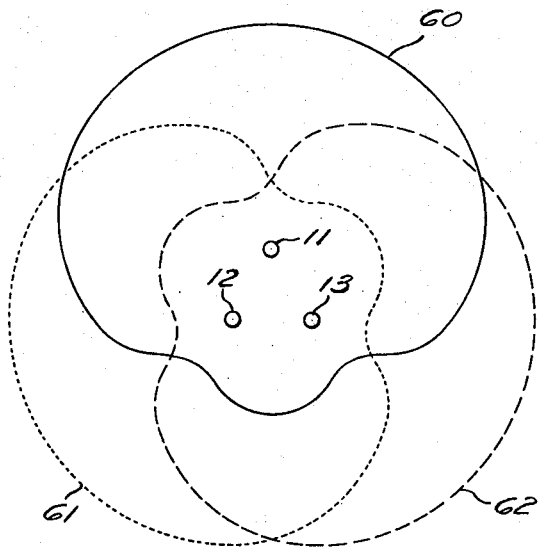
Fig. 4
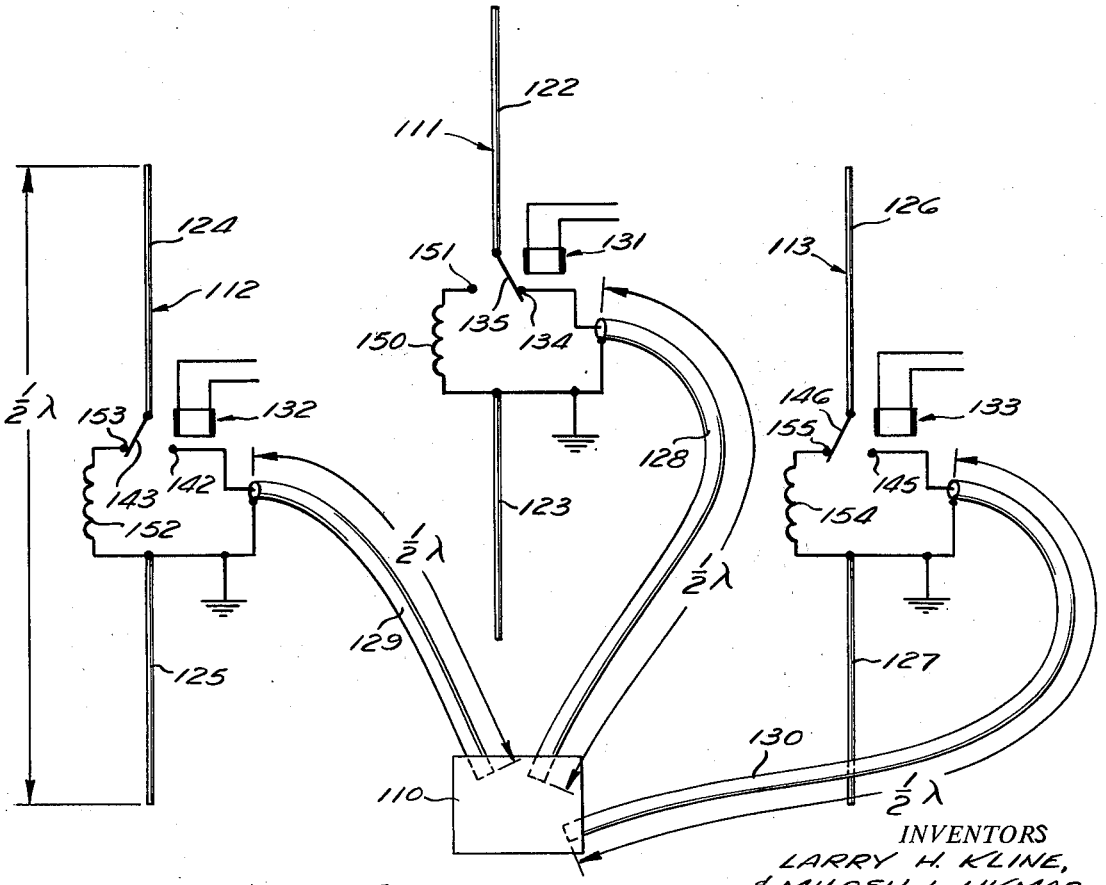
Fig. 5
INVENTORS
LARRY H. KLINE,
& MILOSH L. UKMAR
BY
Ely, Golrick & Flynn
ATTORNEYS Fig. 8
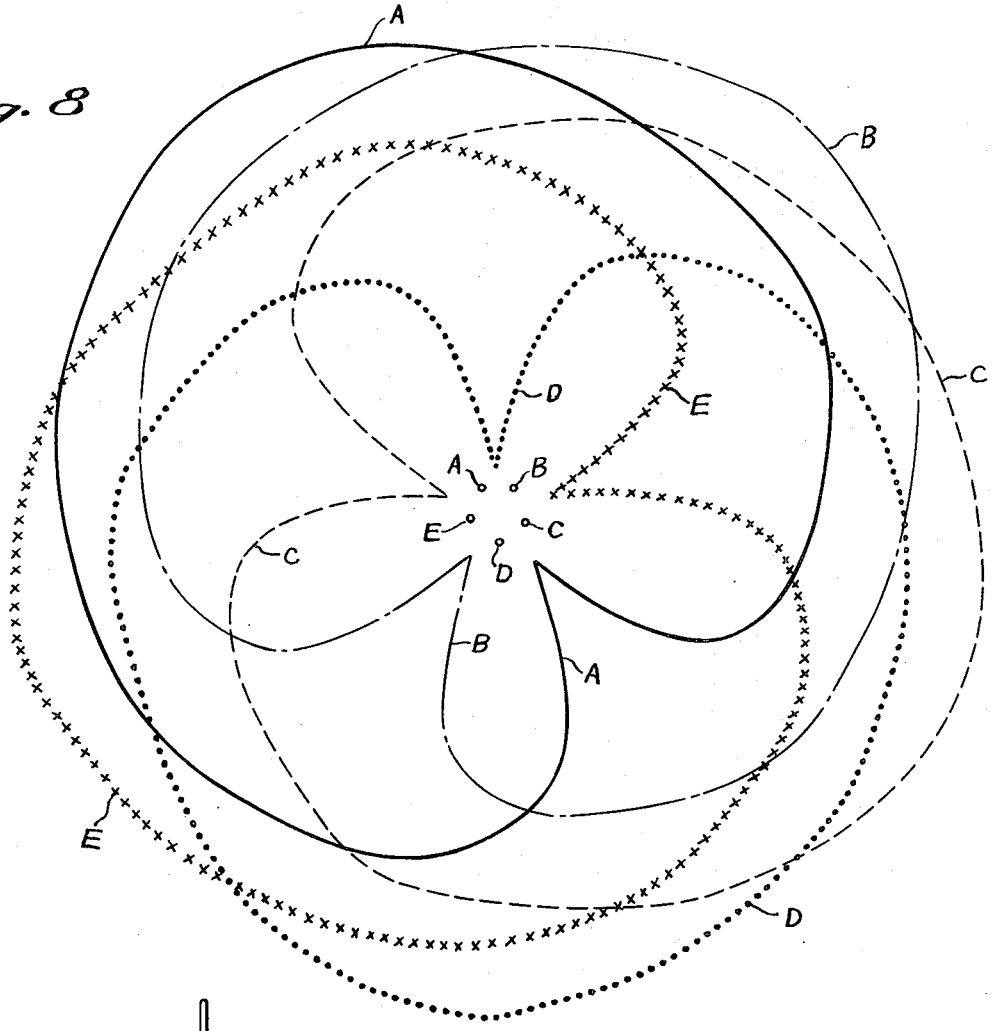
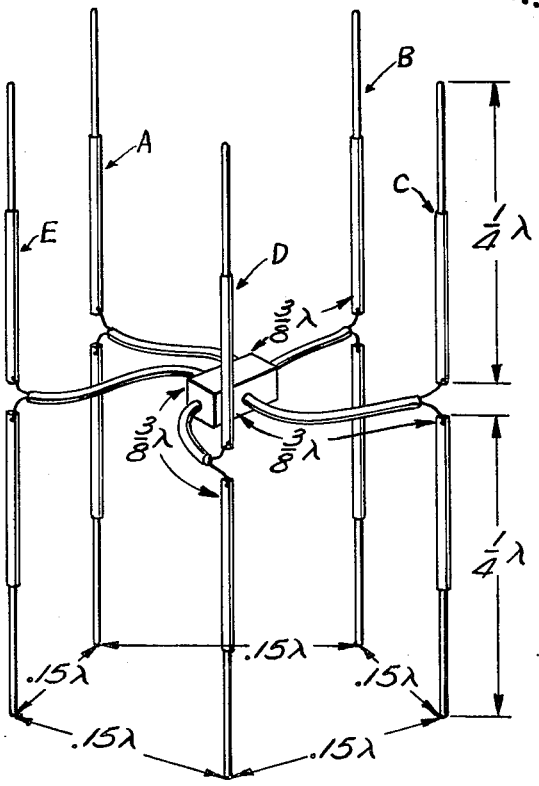
Fig. 6
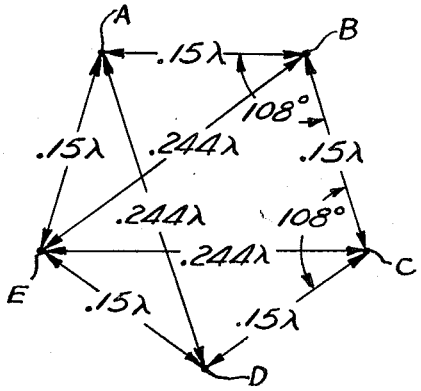
Fig. 7
INVENTORS
LARRY H. KLINE,
& MILOSH L. UKMAR
BY
Ely, Golnick + Flynn
ATTORNEYS

ANTENNA WITH ROTATABLE SENSITIVITY PATTERN

This invention relates to an antenna having a rotatable sensitivity pattern. This application is a continuation-in-part of our application Ser. No. 430,418, filed Feb. 4, 1965, now abandoned.

Prior to the present invention there has been no entirely satisfactory antenna having a directional sensitivity pattern providing much higher sensitivity at one side of the antenna than at the opposite side and adapted to have its directional sensitivity pattern shifted angularly, or rotated, while the antenna itself is physically stationary. Desirably, such an antenna should be omnidirectional, with substantially the same sensitivity in every selected direction. Such an antenna would be highly advantageous for use in radio communications transmitting and/or receiving, for example, because it would enable an operator to shift the directional sensitivity pattern of his antenna for a maximum broadcast and reception sensitivity to a particular radio contact from any direction and would minimize noise from other directions.

The present invention is directed to a novel and improved antenna having this capability.

Accordingly, it is a principal object of this invention to provide a novel and improved antenna whose sensitivity pattern may be rotated electrically without physically rotating the antenna itself.

It is also an object of this invention to provide such an antenna which is adapted to provide substantially uniform sensitivity in every selected direction from the antenna.

Another object of this invention is to provide such an antenna having a plurality of physically spaced antenna units which are energizable one at a time and are so arranged that the non-energized antenna units provide a parasitic reflector for the antenna unit which is energized at that time.

Another object of this invention is to provide such an antenna whose sensitivity pattern can be rotated electrically from a remote location.

Further objects and advantages of this invention will be apparent from the following detailed description of two presently-preferred embodiments thereof, which are illustrated in the accompanying drawings.

In the drawings:

FIG. 3 is a schematic electrical circuit diagram showing the connections of the relays in the relay box to the three coaxial cables which feed the three antenna units in the antenna array of FIGS. 1 and 2;

FIG. 4 is a polar coordinate diagram showing the directional sensitivity pattern of this antenna in each of its three different electrically-rotated conditions;

FIG. 5 is a schematic diagram of an antenna array having a different switching arrangement in accordance with a second embodiment of this invention;

FIG. 6 is a view similar to FIG. 2, but showing a five element antenna array in accordance with the present invention;

FIG. 7 is a schematic top plan view showing the positions of the five antenna units in the FIG. 6 array; and FIG. 8 is a polar coordinate diagram showing the directional sensitivity pattern of the FIG. 6 antenna array in each of its five different electrically-rotated conditions.

Figure 1:
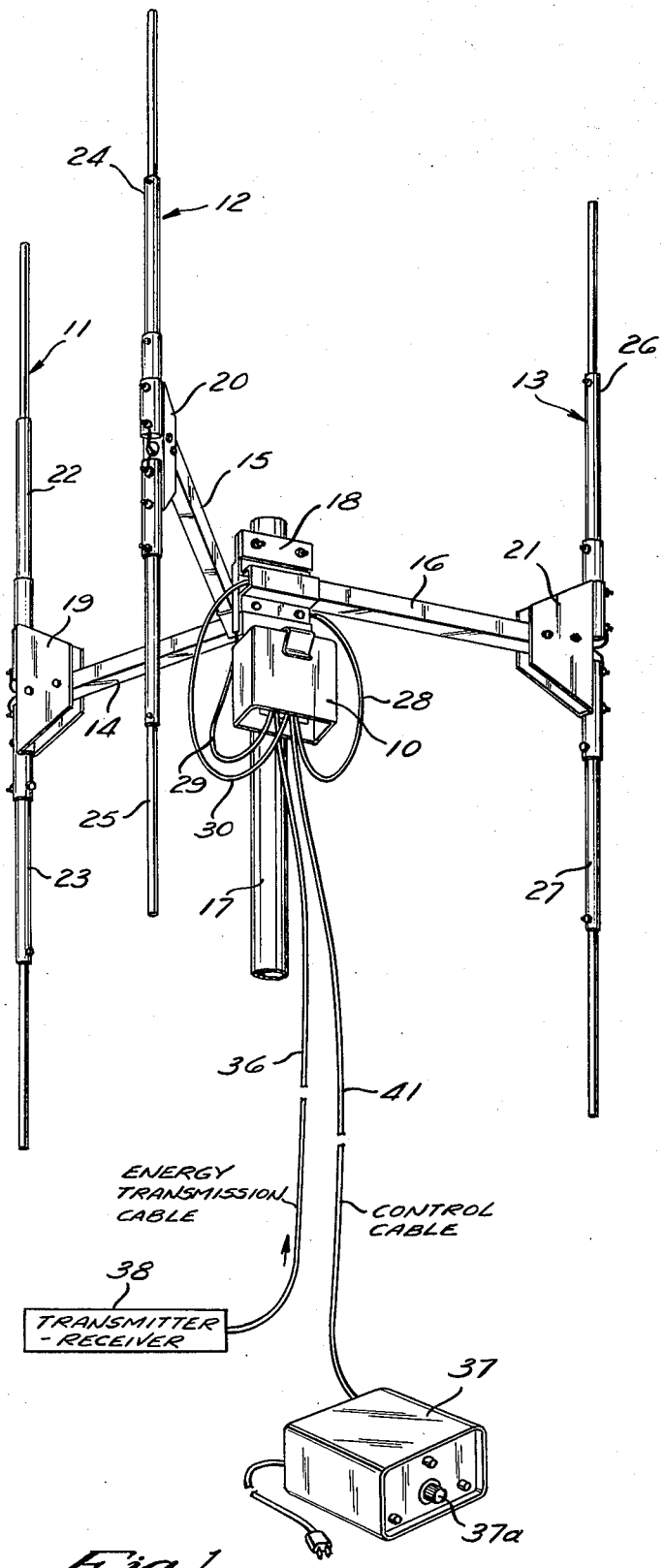
FIG. 1 is a schematic perspective view of an antenna array and the switching control therefor in accordance with a first embodiment of this invention.

Referring first to the embodiment of the present invention shown in FIGS. 1–4, the antenna array shown therein comprises three antenna units 11, 12 and 13 which are rigidly supported by horizontal arms or booms 14, 15 and 16 extending from a central support member constituted by a vertical post or mast 17. The horizontal booms 14–16 are spaced at 120° intervals about the axis of the mast and are of equal lengths, so that the three antenna units are equally spaced from one another and from the mast. The inner ends of the three booms are clamped to the mast 17 near its upper end by a bolt-on bracket assembly 18. At their outer ends, the booms carry bracket units 19, 20 and 21, respectively, which support the antenna units 11, 12 and 13.

In the preferred embodiment of the present invention, each antenna unit is a center-fed, half wavelength dipole. The first antenna unit 11 is made up of a pair of vertically extending, electrically conductive, upper and lower radiating elements 22 and 23, each having a length of substantially one quarter wavelength of the radio signal frequency. The bracket unit 19 positions the lower end of the upper radiating element 22 closely spaced above the upper end of the lower radiating element 23 to provide the dipole gap in the first antenna unit. The second antenna unit 12 is identical, having upper and lower radiating elements 24 and 25, as is the third antenna unit 13 composed of upper and lower radiating elements 26 and 27.

In the preferred embodiment of the present invention, the respective booms 14, 15 and 16 are hollow and they receive respective coaxial cables 28, 29 and 30. As shown schematically in FIG. 2, each of these coaxial cables at its laterally outward end has its outer conductor or sheath connected directly to the dipole gap end of one radiating element of the respective antenna unit and its inner conductor connected directly to the dipole gap end of the other radiating element of that antenna unit. At their respective laterally inward ends the coaxial cables 28–30 are connected to respective relay contacts located in a relay box 10 preferably supported by the bracket assembly 18 on the mast.

Referring to FIG. 3, there are three relays 31, 32 and 33 in the relay box 10, one for each of the antenna units. These relays constitute switching means for selectively enabling the antenna units to be energized one at a time.

The first relay 31 has a fixed contact 34 connected directly to the inner conductor of the coaxial cable 28 feeding the first antenna unit 11. The outer conductor of this cable is connected to the outer conductor or sheath of an energy transmission cable 36 as the latter's upper end. Relay 31 also has a mobile contact 35 which is connected to the inner conductor of the energy transmission cable 36 at the latter's upper end. Contacts 34 and 35 are open normally, that is, as long as relay 31 is not energized.

As shown in FIG. 1, the lower end of the energy transmission cable 36 is connected to a radio transmitter/receiver 38 located remote from the antenna itself.

The opposite sides of the coil of the first relay 31 are connected to a pair of wires 39 and 40 in a multi-conductor control cable 41, which extends down to the control box 37 located remote from the antenna itself, as shown in FIG. 1. The control box 37 contains a rotary selector switch of conventional design (not shown), which is operated by a manual control knob 37*a* to selectively connect one of the relays 31, 32 or 33 in the relay box 10 to a power supply (not shown).

In operation, when the selector switch in control box 37 is turned to a first position it connects the coil of the first relay 31 across the power supply (by way of wires 39 and 40) and disconnects the other two relays 32 and 33 from the power supply. When thus energized, relay 31 closes its contacts 35, 34. This connects the respective antenna unit 11 to the transmitter/receiver 38 by way of the energy transmission cable 36.

the second relay 32 in relay box 10 similarly has a fixed contact 42, connected to the inner conductor of the coaxial cable 29 feeding the second antenna unit 12, and a mobile contact 43, connected to the inner conductor of the energy transmission cable 36. Contacts 42 and 43 are normally open (i.e., a long as the coil of relay 32 is not energized). The outer conductor of cable 29 is connected to the outer conductor of energy transmission cable 36. The coil of relay 32 is connected across wire 40 and a third wire 44 of the control cable 41.

In a second position of the control knob 37a at the control box 37 the rotary selector switch therein connects the coil of the second relay 32 in relay box 10 across the power supply and at the same time disconnects the coils of the other two relays 31 and 33 from the power supply. When thus energized, relay 32 closes its contacts 43, 42, thereby connecting the second antenna unit 12 to the transmitter/receiver 38 by way of the energy transmission cable 36.

The third relay 33 in relay box 10 similarly has a fixed contact 45, connected to the inner conductor of the coaxial cable 30 feeding the third antenna unit 13, and a mobile contact 46, connected to the inner conductor of the energy transmission cable 36. Contacts 45 and 46 are normally open (i.e., as long as the coil of relay 33 is not energized). The outer conductor of cable 30 is connected to the outer conductor of energy transmission cable 36. The coil of relay 33 is connected across wire 40 and a fourth wire 47 of the control cable 41.

In a third position of the control knob 37*a* at the control box 37 the rotary selector switch therein connects the coil of the third relay 33 in relay box 10 across the power supply and at the same time disconnects the coils of the other two relays 31 and 32 from the power supply. When energized, relay 33 closes its contacts 46, 45 to connect the third antenna unit 13 to the transmitter/receiver 38 by way of the energy transmission cable 36.

With this arrangement it will be apparent that the operator can selectively energize the antenna units one at a time by turning the control knob 37*a* to a position connecting the selected respective relay in the relay box 10 across the power supply and disconnecting the other two relays from the power supply. At any one of these three positions of the control knob, only one antenna unit is connected in the energy transmission circuit to the transmitter/receiver 38 and the other two antenna units are disconnected from it.

In accordance with the present invention, a novel arrangement is provided for enabling the two idle antenna units to act as parasitic reflectors for the antenna unit which is energized at any given time. This is accomplished by providing an inductive reactance connected across the dipole gap between the neighboring ends of the upper and lower radiating elements of the idle antenna units. This causes the idle antenna units to be longer electrically than the active or energized antenna unit, so that the idle antenna units act as parasitic reflectors for the active antenna unit.

In the embodiment of FIGS. 1–4 this inductance element for each idle antenna unit is constituted by the respective coaxial cable 28, 29 or 30 connecting it to the relay box 10. The electrical length of each of these cables is chosen to provide this effect. (The actual dimension length of each coaxial cable will be shorter than its electrical length, depending upon the velocity of propagation of signal energy alongside the cable.)

In the particular arrangement shown schematically in FIG. 3, the coaxial cable 28, 29 or 30 for each idle antenna unit is open-circuited at the relay box 10. An open-circuited coaxial cable presents an inductive reactance when its electrical length is within the range from ¼ or ½ wavelength, or between ¾ and 1 wavelength, and each additional half wavelength increment in this series, with the maximum inductive reactance being at ⅜ wavelength, ⅞ wavelength, 1-⅜ wavelengths, or any other additional half wavelength increment in this series. In practice, it is preferred to make this electrical length of each cable ⅜ wavelength because this provides a convenient dimensional length.

Alternatively, the relay circuitry at the relay box 10 might be arranged so that each coaxial cable 28, 29 or 30 is short-circuited there when the respective antenna unit is disconnected from the transmitter/receiver 38. A short-circuited coaxial cable presents an inductive reactance when its electrical length is between zero and ¼ wavelength, or between ½ and ¾ wavelength, and each additional half wavelength increment in this series, with the maximum inductive reactance occurring at ⅛ wavelength, ⅝ wavelength, 1-⅛ wavelengths or any other additional half wavelength increment in this series. In practice, ⅛ wavelength is an impractically small value because it requires an excessively close physical spacing of the antenna units, and therefore ⅝ wavelength would be the preferred electrical length of each of the coaxial cables 28, 29 and 30 if they are short-circuited at the relay box 10.

Figure 2:
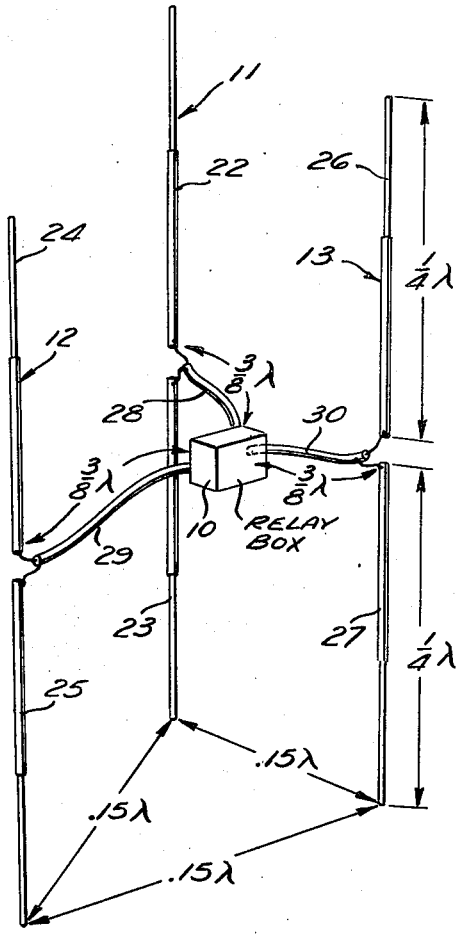
FIG. 2 is a schematic perspective view showing the three antenna units, the relay box, and the coaxial cables feeding the respective antenna units in the FIG. 1 antenna array.

As already pointed out, the three antenna units 11, 12 and 13 are equidistant from each other, and their spacing is adjusted empirically to provide the optimum directional pattern for the antenna array. In practice, a spacing between the three antenna units of 0.15 wavelength (as indicated in FIG. 2) has been found to provide a directional pattern as indicated in FIG. 4.

As shown in this Figure, when the first antenna unit 11 is energized, the antenna sensitivity pattern is as shown by the full line 60, with maximum sensitivity at the side where the energized antenna unit 11 is located and minimum sensitivity at the opposite side due to the parasitic reflecting action of the idle antenna units 12 and 13 and the respective inductive reactances provided by their coaxial cables 29 and 30.

When the second antenna unit 12 is energized, the antenna has the directional sensitivity pattern indicated by the dotted line 61, with maximum sensitivity at the side where the energized antenna unit 12 is located and minimum sensitivity at the opposite side due to the parasitic reflecting action of the idle antenna units 11 and 13 and the respective inductive reactances provided by their coaxial cables 28 and 30.

When the third antenna unit 13 is energized, the antenna has the directional sensitivity pattern indicated by the dashed line 62 in FIG. 4, with maximum sensitivity at the side where the energized antenna unit 13 is located and minimum sensitivity at the opposite side due to the parasitic reflecting action of the two idle antenna units 11 and 12 and the respective inductive reactances provided by their coaxial cables 28 and 29.

From FIG. 4 it will be apparent that each of these three directional patterns provides substantially uniform sensitivity throughout an arc of about 120° at the side where the energized antenna unit is located. The three direction patterns overlap and together they provide a substantially uniform and omnidirectional overall pattern with substantially uniform sensitivity in all directions being attainable simply by operating the selector switch in the remotely located control box 37 to switch the transmitter/receiver 38 from one antenna unit to the next.

FIG. 5 illustrates schematically a second embodiment of the present invention in which elements corresponding to those in the embodiment of FIGS. 1–4 are given the same reference numerals plus 100. The embodiment of FIG. 5 differs from that of FIGS. 1–4 in that the switching of each antenna unit into or out of the energy transmission circuit takes place at the laterally outward ends of the respective coaxial cables which feed the antenna units, instead of at their inward ends. In this embodiment these coaxial feed cables are not employed to provide the inductive reactances which enable the idle antenna units to act as parasitic reflectors. Instead, a separate inductive reactance is provided for each antenna unit. The physical support arrangement for the three antenna units may be the same as in FIGS. 1–4.

Referring to FIG. 5, the separate inductive reactance for the first antenna unit 111 is constituted by a coil 150 located at, or close to, the dipole gap between its upper and lower radiating elements 122 and 123. Coil 150 has its lower end connected directly to the upper end of the lower antenna element 123, which is grounded. The upper end of coil 150 is connected to a fixed relay contact 151. A cooperating mobile contact 135 is connected directly to the lower end of the upper radiating element 122. Normally (i. e., when relay 131 is not energized) its mobile contact 135 engages contact 151, thereby connecting the inductive reactance coil 150 between the adjoining ends of the upper and lower radiating elements 122 and 123 of the first antenna unit 111. When relay 131 is energized, however, its mobile contact 135 engages the fixed contact 134 to connect the upper antenna element 122 to the inner conductor of coaxial cable 128 at the laterally outward end of this cable. The outer conductor of this cable is grounded. At its opposite, laterally inward end, at a box 110 carried on the upper end of the mast, cable 128 is connected to the energy transmission cable (not shown) which extends down to the transmitter/receiver. The electrical length of cable 128 is one-half wavelength.

A similar arrangement composed of an inductive reactance coil 152, relay contacts 153, 143 and 142, relay 132 and coaxial cable 129 is provided for the second antenna unit 112.

Likewise, a similar arrangement, composed of an inductive reactance coil 154, relay contacts 155, 146 and 145, relay 133 and coaxial cable 130, is provided for the third antenna unit 113.

In the operation of this antenna, the three relays 131, 132 and 133 are connected through a control cable to a remote selector switch which may be manually operated to connect only one relay at a time to a power supply, as in the embodiment of the invention shown in FIG. 1–4. The three relays constitute switching means enabling the three antenna units to be energized one at a time. Whichever relay is thus energized operates its mobile contact to connect the respective antenna unit through the respective coaxial cable 128, 129 or 130 to the energy transmission cable connected to the transmitter/receiver. At the same time the other two relays are de-energized, so that the respective inductive reactance coils are connected between the upper and lower radiating elements of the respective antenna units. The two idle antenna units and their respective inductive reactance coils together provide a parasitic reflector which enables the energized antenna unit to have a sensitivity pattern as indicated in FIG. 4.

From the foregoing description it will be evident that each of the two illustrated embodiments of the present invention constitutes a novel and advantageous arrangement enabling the sensitivity pattern of the antenna to be rotated without physically rotating the antenna itself, but simply by selectively switching from one antenna unit to another so as to provide maximum sensitivity in the direction desired for optimum transmission or reception. Each antenna unit in the complete array has a relatively wide beam characteristic, with relatively uniform sensitivity throughout an arc of about 120°, as shown in FIG. 4, and the overall pattern of the three antenna units provides substantially uniform sensitivity in all directions around the antenna.

While two presently-preferred embodiments of the invention have been shown and described, it is to be understood that the invention is susceptible of other embodiments without departing from the spirit and scope of the present invention. For example, if desired, instead of three antenna units there may be four or more in the array, energized separately one at a time and provided with inductive reactances when idle so as to provide a parasitic reflector for the antenna unit which is then energized.

Likewise, as a further illustrative example of an array of more than three units, a five element antenna array may be provided as shown in FIG. 6, having five equally spaced center-fed, half wavelength dipoles and otherwise similar to the three element array described with reference to FIGS. 1–4. The directional sensitivity pattern of this five element antenna array is depicted in FIG. 8, in which the switching element energizes only one antenna unit at a time, the extended lobes being indicated as A to E for each of the corresponding individually energized dipole units also indicated as A to E.

Whether the array consists of three or more dipole antenna units, the sides of the polygon at the corners of which the units are located are preferably maintained at lengths of approximately 0.15 wavelength as indicated, necessarily and obviously increasing the length of the arms (similar to arms 16 in FIG. 6) or similar means by which the dipole units are mechanically supported at the corners of the polygonal array and thus substantially equidistant from the center of the polygon.

While any such array of three or more antennas made according to this invention eliminates the need, but not the function, of an antenna or reflector physically or effectively located at the center of an array having a rotatable sensitivity pattern and four or more units at the corner of a polygonal array increases the number of angularly disposed directional sectors permitting more precise location of incoming signals or beaming of emitted signals, these advantages are subject, practically, to diminishing returns due to the requisite increase in cost resulting from the need for the greater mechanical strength (to provide resistance to expectable wind loads) of the means supporting the antenna units the appropriate distance from the center of the polygon. Likewise, in the case of a three unit array, operation of the switching unit 37, for example, will necessarily switch the extended lobe of sensitivity, clockwise or counter-clockwise, to an adjacent lobe of sensitivity. With arrays of four or more units, the shifting of the lobe of increased sensitivity, on either side of and behind all energized units. Referring to FIG. 6, for example, if antennas C, D, and E are electrically lengthened, antennas A and B may be energized simultaneously; this will provide a broader area of a sector or lobe having some degree of extended sensitivity and from which the intensity and directionality of the signal may be more precisely increased by selectively deenergizing and electrically lengthening units A or B to ascertain optional directionality and maximum extension of sensitivity permitted by such an array.

What is claimed is:

1. An antenna having a rotatable sensitivity pattern and comprising an array of three spaced, substantially vertical, centerfed half wavelength dipole antenna units substantially equidistant from each other by a horizontal distance of substantially 0.15 wavelengths and each having an upper and a lower radiating element separated by a dipole gap, three coaxial cables connected respectively at one end to the antenna units, each of said cables at said one end thereof having an outer conductor connected to one of the radiating elements of the respective antenna unit at one side of the dipole gap and an inner conductor connected to the other radiating element of said antenna unit at the opposite side of the dipole gap, and switching means connected to said coaxial cables at the opposite ends thereof and operable selectively to energize the antenna units one at a time through the respective coaxial cables and to de-energize the two remaining antenna units, each of said coaxial cables having an electrical length such that it constitutes an inductive reactance connected across the dipole gap between the radiating elements of the respective antenna unit when the latter is de-energized by said switching means, whereby the two de-energized antenna units and their respective coaxial cables act as parasitic reflectors for the antenna unit then energized, means to support to said antenna units in their said spaced substantially vertical position, including substantially vertical mast means having a centerline substantially coinciding with the line defined by the centers of the upper and lower substantially equilateral triangles defined by the upper and lower ends of said dipole antenna units.

2. The antenna of claim 1, wherein said switching means open-circuits each of the coaxial cables for the deenergized antenna units at said opposite end thereof, and each coaxial cable has an electrical length within the series consisting of substantially ⅜ wavelength and half wavelength additions thereto.

3. The antenna of claim 1, wherein said switching means short-circuits each of the coaxial cables for the deenergized antenna units at said opposite end thereof, and each coaxial cable has an electrical length within the series consisting of substantially ⅛ wavelength and half wavelength additions thereto.

4. An antenna for producing a rotatable sensitivity pattern comprising three or more antenna units spaced apart from each other and each located at a corner of a substantially regular polygon, said antenna units each comprising a dipole unit having a gap at its center across which said dipole unit is fed, switching means having connections to said antenna units and operable selectively to energize less than half the numbers of said antenna units, and means connected to said switching means and effective in response thereto to add to the effective electrical length of remaining idle antenna units, whereby the latter act as parasitic reflectors for the energized antenna unit, said connecting means comprising coaxial cables, each extending from said switching means to the gap in a dipole unit, the center conductor of said cable being connected to one element of said dipole unit and its outer conductor being connected to the other element of said dipole unit, whereby, when a cable does not energize an antenna unit, said inner and outer conductors provide an inductance electrically lengthening the dipole unit to which it is connected, all said reflectors being located, with respect to the desired directionality of increased sensitivity of one or more energized units, behind any energized unit and with at least one electrically lengthened unit on either side of and perpendicularly farther than any energized unit from the line of desired directionality, and no energized unit being at a distance substantially greater than 0.244 wavelength from a reflector.

5. An antenna according to claim 4 wherein the spacing between said antenna units is substantially 0.15 wavelength, and the mechanical length of the radiating element of each dipole antenna is approximately a quarter wavelength.

* * * * *